US006584921B2

(12) United States Patent
Laufer et al.

(10) Patent No.: US 6,584,921 B2
(45) Date of Patent: Jul. 1, 2003

(54) METHOD AND SYSTEM FOR MODIFICATION EMBROIDERY STITCH DATA AND DESIGN

(75) Inventors: John S. Laufer; Lisa A. Laufer, both of Danville, CA (US)

(73) Assignee: Buzz Tools, Inc., Danville, CA (US)

( * ) Notice: Subject to any disclaimer, the term of this patent is extended or adjusted under 35 U.S.C. 154(b) by 0 days.

(21) Appl. No.: 09/908,479

(22) Filed: Jul. 17, 2001

(65) Prior Publication Data

US 2002/0043203 A1 Apr. 18, 2002

Related U.S. Application Data

(60) Provisional application No. 60/219,077, filed on Jul. 18, 2000.

(51) Int. Cl.[7] ..... D05B 19/04; D05C 9/06

(52) U.S. Cl. ..... 112/475.19; 112/445; 112/102.5

(58) Field of Search ..... 112/102.5, 475.19, 112/470.01, 273, 278, 445, 456, 458; 700/138, 136, 137; 340/815.4

(56) References Cited

U.S. PATENT DOCUMENTS 4,577,574 A 3/1986 Takahashi
4,821,662 A 4/1989 Pongrass et al.
5,191,536 A 3/1993 Komura et al.
5,311,439 A 5/1994 Hayakawa et al.
5,319,565 A * 6/1994 Hausammann ..... 112/458 X
5,320,054 A 6/1994 Asano
5,343,401 A 8/1994 Goldberg et al.
5,671,689 A 9/1997 Clapp et al.
5,727,485 A 3/1998 Morita
5,740,057 A 4/1998 Futamura
5,746,145 A 5/1998 Cox et al.
5,839,380 A 11/1998 Muto
5,865,134 A 2/1999 Okuyama et al.
5,974,992 A * 11/1999 Asano ..... 112/102.5
6,167,823 B1 * 1/2001 Laufer et al. ..... 112/102.5

* cited by examiner

*Primary Examiner*—Peter Nerbun
(74) *Attorney, Agent, or Firm*—Townsend&Townsend&Crew LLP

(57) ABSTRACT

A method and system using a novel user display. The user interface device includes a display for a multiple-file, multiple-section or multiple-hoop embroidery designs. The display is coupled to a micro processing device such as a microprocessor, microcomputer, or the like. The display also has a representation a stitch on a first axis of the display. The display also shows a property of the stitch on a second axis of the display, where the second axis is associated with the first axis. The property is section identifier, filename, or hoop position. Other features can also be included depending upon the application.

24 Claims, 9 Drawing Sheets

METHOD AND SYSTEM FOR MODIFICATION EMBROIDERY STITCH DATA AND DESIGN

CROSS-REFERENCE TO RELATED PATENT APPLICATION

This application claims priority to U.S. application Ser. No. 09/707,668 filed Nov. 6, 2000, which is a continuation of U.S. Pat. No. 6,167,823 issued Jan. 2, 2001 and filed Jul. 21, 1999; and U.S. Provisional Patent Application No. 60/219,077 filed Jul. 18, 2000, Method and System for Modification of Embroidery Stitch Data and Design, each of which is commonly assigned, and hereby incorporated by reference herein for all purposes.

BACKGROUND OF THE INVENTION

The present invention relates generally to embroidery applications. More particularly, the present invention provides a technique including a method, system, and device for analyzing stitch information on embroidery patterns, which are used on commercial and non-commercial sewing applications.

Computerized sewing machines have generally evolved to almost automatically stitch complex designs onto pieces of cloth to create an embroidery design. The design is derived from embroidery stitch data. In the sewing machine, embroidery stitch data often translates into a series of stitches to be sewn on a work cloth to form an embroidery design. The stitch data include an ordered set of stitch coordinates or displacements and interspersed control codes. The stitch coordinates generally specify a spatial location where the embroidery needle pierces the work cloth. The control codes generally specify events. These events include thread changes used mainly to change the color of the thread; long or jump stitches; and end of the embroidery design.

The stitches are often numbered as coordinates from "1" to "n," where n is the total number of stitches in the design. For example, stitch number 1 corresponds to the first needle pierce, stitch number 2 corresponds to the second needle pierce, and stitch number n corresponds to the last needle pierce. The set of embroidery stitch data for a design is commonly called a stitch-based design, and is often saved as a computer file which is referred to as a design file.

Depending on the computerized sewing machine and the software used to create such designs, design files may have limitations such as a maximum number of stitches or colors the design file can contain, or the maximum dimensions that the design represented by the file can span. The latter is often imposed by the size of the hoop frame that the cloth is set into. These limitations are generally more severe on so-called home embroidery machines as opposed to professional embroidery machines, although professional embroidery machines also have certain limitations.

To circumvent limitations such as the maximum number of stitches or number of available colors a design file can contain, the stitches in a design are sometimes split into two or more sections, and each section is saved into a separate design file, such that the number of stitches and/or colors in each design file does not exceed the maximum allowable by the particular technique. By sewing the design sections or files one after the other onto the same piece of cloth, a complex embroidered design that contains an arbitrary number of stitches and/or colors is created.

To circumvent the limitation of maximum dimensions a design file can contain, the stitches in a design are sometimes split into two or more sections, such that the x- and y-dimensions spanned in each section does not exceed the maximum. The stitches in each section can be in a separate file, or depending on the file format may be saved in one file. Either way, by sewing the sections one after the other onto adjacent or overlapping regions on the same piece of cloth, an embroidered design that spans an arbitrary area is created. To sew the sections onto adjacent or overlapping regions, the fabric is often shifted and reset into the hoop frame between sections. Alternatively, some sewing machine manufacturers or third parties have developed so-called 'multiple-position hoops', which have two (2) or more brackets that allow the hoop to be mounted to the sewing machine in two or more positions, and thus different sections of a design can be sewn onto adjacent or overlapping areas of a piece of fabric without the need for resetting the fabric in the hoop.

Conventional software used to create and manage multiple-section designs (multiple-file designs or multiple-hoop designs) designs has severe limitations. Conventional software generally splits the stitches in the design amongst the sections automatically without user interaction or control by a predetermined manufacturer technique. The software often does not give a result that the user intends. For example, it is often desirable to have each individual element of the design fall entirely within one section. Automatic software will often arbitrarily assign part of an element to one section, and another part of the element to another section without any regard to the user's desires.

From the above, it is seen that improved tools for multiple-section embroidery designs are desirable.

SUMMARY OF THE INVENTION

According to the present invention, a technique for analyzing and manipulating stitch information in a multiple-section embroidery pattern is provided. In an exemplary embodiment, the present invention provides a user device, method, and computer software for identifying characteristics of stitch data using a computer interface device. The present user device and method allow, for example, a user to easily identify the block of stitches assigned to each section of a multiple-section design, and to use other "Stitches-in-Time" graphs such as the color bar, stitch length and stitch angle graphs, to assign or re-assign blocks of stitches to the various sections of a multiple-section design. The Stitches in Time graphs were described in U.S. Pat. No. 6,167,823, but should not be limiting the scope of the claims defined herein.

In a specific embodiment, the present invention provides a graphical user interface device. The user interface device includes a display for an embroidery design, which is shown in electronic form. The display is coupled to a microprocessing device such as a microprocessor, microcomputer, or the like. The display also has a representation of a stitch (or plurality of stitches) in electronic form on a first axis of the display. The display also shows a property of the stitch in electronic form on a second axis of the display, where the second axis intersects the first axis for reference. The property of the stitch can include, among others, a section number or other identifier, which can in turn represent a particular filename or a particular hoop position. Other features can also be included depending upon the application.

In an alternative aspect, the present invention provides a method for moving one or more consecutive stitches in an embroidery design from one section to another. The method includes providing stitch data that defines an embroidery design, where the stitch data include a plurality of stitches.

By methods described in U.S. Pat. No. 6,167,823 or other suitable techniques, a selection is defined by a user, where the selection includes a plurality of stitches in between a starting stitch and an ending stitch. The method also includes defining an insertion point in a stitches-in-time graph before or after any stitch in the design. The method also includes moving the selected stitches to the insertion point, so that the selected stitches are sewn in a different order with respect to the other stitches in the design.

In an alternative aspect, the present invention provides a method for adding a section to a multiple-section design. The section may represent a particular filename or hoop position, for example. The method includes providing stitch data represented by one or more stitches-in-time graphs. The method also includes inserting a section flag before or after any stitch in the design. The method also includes assigning any stitches after the newly added section flag and before any following section flag to the new section. The method also includes specifying the properties or name of the new section.

Numerous benefits are achieved by way of the present invention over conventional techniques. In a specific embodiment, the present invention provides easy to use tools to partition a design amongst multiple files and/or multiple hoop positions. Here, a goal is attained through a novel "multiple-section graph". The graph has stitch number or time as one axis, and section, file, or hoop identifier of each stitch as the other axis. In an alternative embodiment, the present invention provides an improved method to assign stitches within a stitch-based design to sections, files, or hoop positions. Here, the present invention uses Stitches-in-Time charts and graphs, especially the stitch length chart, by enabling a user to easily move a run of consecutive stitches between any two sections in the design. The invention also provides an easy way to manipulate larger designs than the largest design area supported by a design file type. The larger designs often require the use of multiple-position hoops for forming the design on a piece of cloth. Depending upon the embodiment, one or more of these advantages may exist, without limiting the scope of the claims herein.

These and other embodiments of the present invention, as well as its advantages and features, are described in more detail in conjunction with the text below and attached FIGS.

DESCRIPTION OF THE SPECIFIC EMBODIMENTS

According to the present invention, a technique for analyzing stitch information on an embroidery pattern is provided. In exemplary embodiment, the present invention provides a user device, method, and computer code for identifying characteristics of stitch data using a computer interface device. The present invention can allow a user to easily identify characteristics of the embroidery stitch data such the section or file in which each stitch data resides. Details of the present invention are described throughout the present specification and more particularly by way of the Figs. below.

Figure 1:
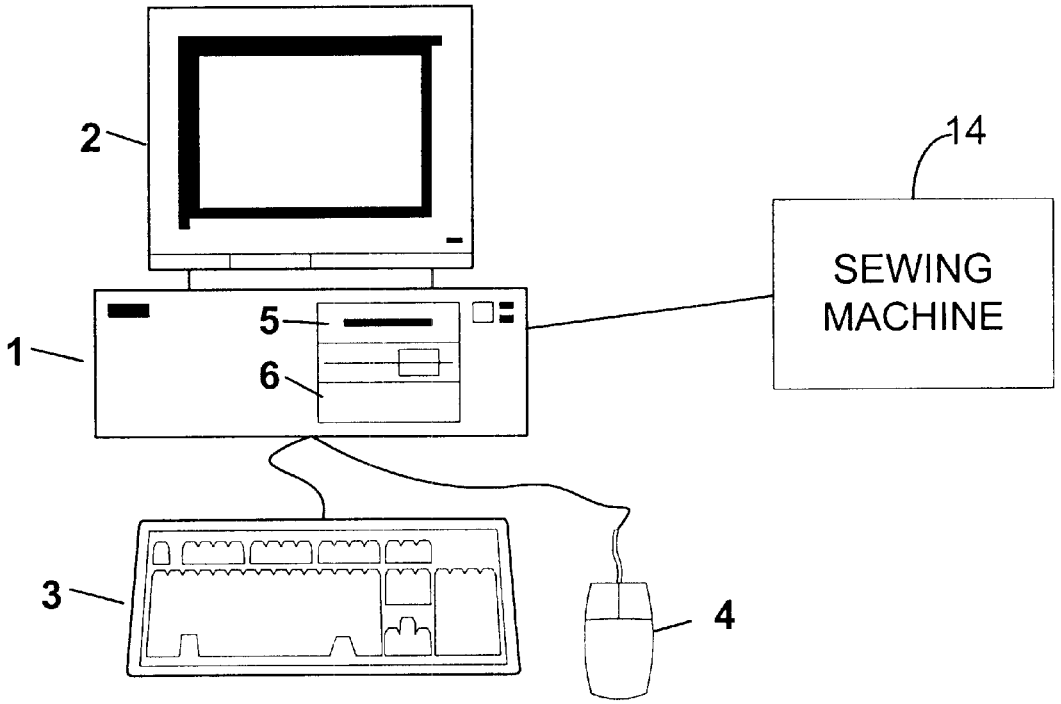
FIG. 1 is a simplified diagram of system hardware for an embroidery data processing device according to an embodiment of the present invention.

FIG. 1 is a simplified schematic view diagram of an embroidery data processing apparatus that is used as a stitch editor. This diagram is merely an example which should not limit the scope of the claims herein. One of ordinary skill in the art would recognize many other variations, modifications and alternatives. The embroidery data processing apparatus includes a display 2 for displaying pictures, charts and graphs. The display can include a cathode ray tube ("CRT"), flat panel display, or the like. The display is coupled to a microcontroller unit 1. The microcontroller unit can be a microprocessor-based computer or personal computer such as an Intel based design or the like. The microcontroller unit includes interfaces devices such as a keyboard 3 and a mouse 4 for collecting input from a user. The microcontroller also has a memory storage unit, such as a floppy disk device 5 and hard disk device 6 for storing embroidery data.

The data processing apparatus can be coupled to a sewing machine (or embroidering machine) 14. The sewing machine includes a variety of features such as a frame that can be mounted on a stage. The stage can be capable of moving the frame in two or three dimensions. These dimensions include an x-direction, a y-direction, and a z-direction. A sewing needle and a hook mechanism are also included. A piece of cloth is fixed in the hoop frame, which moves the cloth in a pattern to form the embroidery design on it. The sewing machine also has a variety of electronic elements, which are used to oversee operation of the hardware features. These elements include, among others, a microcomputer, which controls the stage and needle. The microprocessor also retrieves information from memory, which includes the embroidery data, and converts the data in to a sequence of stitches for providing the design onto the cloth for embroidery purposes. These and other elements are included in the sewing machine apparatus. As merely an example, the sewing machine can be any suitable computer enhanced machine for personal or commercial use.

Figure 2:
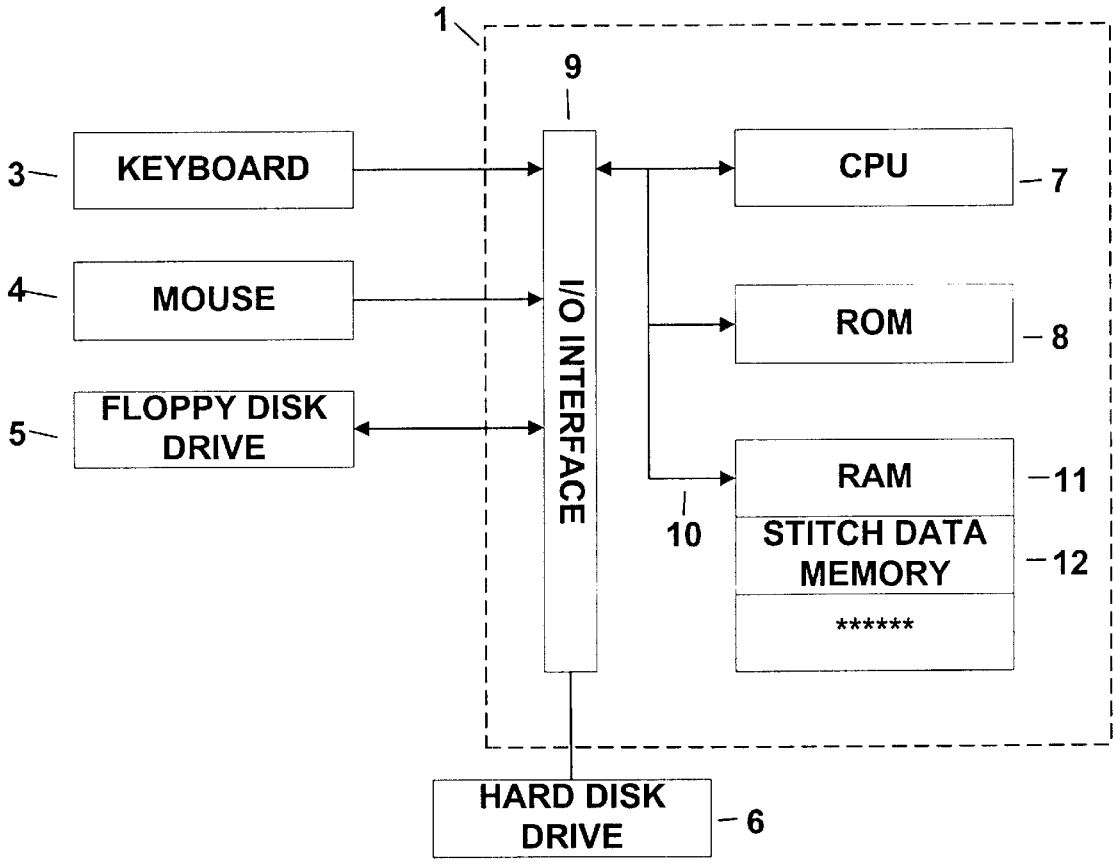
FIG. 2 is a simplified block diagram illustrating a control system of an embroidery data processing device according to an embodiment of the present invention.

FIG. 2 is a block diagram illustrating a control system of the embroidery data processing apparatus, which can be included in the above systems. The control unit 1 includes the CPU 7 which is connected with an input/output (I/O) interface 9 through a bus 10 having a data bus and the like. The controlling unit further includes a ROM (Read Only memory) 8, and a RAM (Random Access Memory) 11. In the ROM 8 and/or the RAM 11, control programs to be executed by the CPU 7 to create the embroidery data are stored. The RAM 11 includes a stitch data memory 12 that stores the embroidery stitch data in a common format. The ROM can also be replaced by a variety of other memory devices such as a flash memory device and others.

The above figure describes aspects of the invention illustrated by elements in simplified system diagrams. As will be understood by one of ordinary skill in the art, the elements can be implemented in computer hardware. The elements can also be implemented, in part, through computer software or firmware. Alternatively, the elements can be implemented in a combination of computer hardware and software. Some of the elements may be integrated with other software and/or hardware. Alternatively, some of the elements may be combined together or even separated. These and other variations, modifications, and alternatives will be apparent by one of ordinary skill in the art. Further details of methods according to embodiments of the present invention can be found throughout the present specification and more particularly below.

Figure 3:
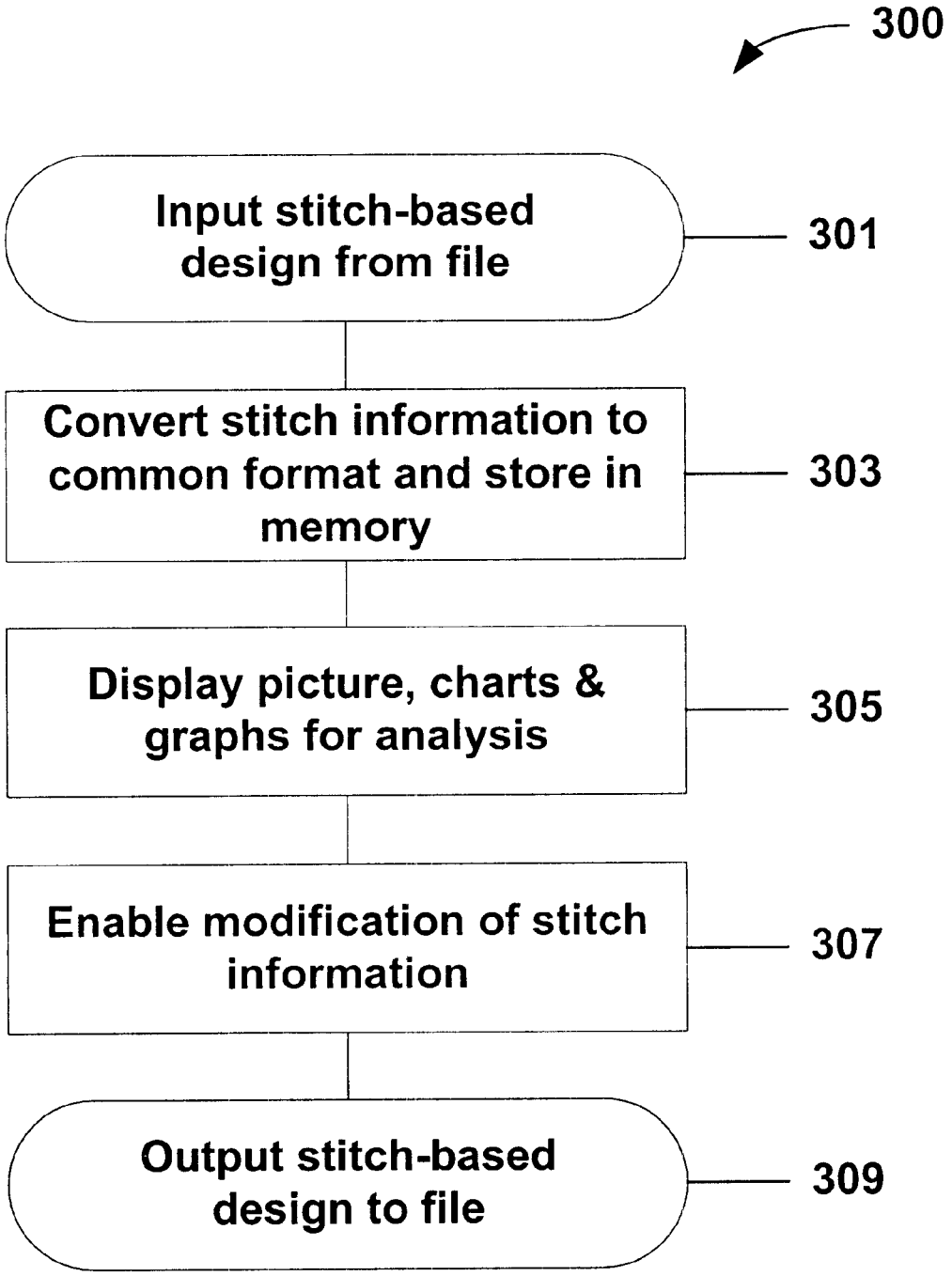
FIG. 3 is a simplified flow diagram of the embroidery data processing method according to an embodiment of the present invention.

FIG. 3 is a simplified flowchart 300 illustrating a process for analyzing and modifying embroidery stitch data according to an embodiment of the present invention. This chart is merely an example, which should not limit the scope of the claims herein. One of ordinary skill in the art would recognize many other variations, alternatives, and modifications. The method provides a stitch-based design in a suitable file format. In particular, the embroidery stitch-based design is read (step 301) from a file or files located on the hard drive or a floppy disk or other memory device. Next, the method converts (step 303) the stitch-based design into a common memory format. The formatted design is stored in the stitch data memory. A picture of the stitches in 2-dimensional space is presented on a display (step 305) to a user, as are the charts and graphs collectively called the "Stitches-in-time" graph and described below. The user analyzes the stitch data by means of the picture, charts and graphs. Based upon the analysis, the method then modifies (step 307) the stitch data by use of the keyboard and mouse. Depending upon the embodiment, the modification can vary from design to design. Next, the method saves (step 309) the modified design back to the same file or files or a different file or files. Further details of these general steps are provided below.

In a specific embodiment, the input stitch-based embroidery design is originally produced by another embroidery creating data processing system. It may have been obtained from an internet or the Internet or various other means. The output stitch-based embroidery design is sent to an automatic sewing machine by another embroidery data processing system. Alternate configurations of the invention may involve reading or writing the stitch data to a memory card or directly to an automatic sewing machine.

We previously have described several Stitches-in-Time graphs and charts in U.S. Pat. No. 6,167,823: The stitch length chart, which plots stitch length, the stitch angle chart, which plots stitch angle and, and the stitch color chart. We now describe another representation: The multiple-section chart is a component bar chart that shows the section identifier for each stitch in the design. A section may represent a single file of a multiple file design, or a single hoop position of a multiple-hoop position design, for example. Each run of consecutive stitches in one section is shown as a rectangle with a section indentifier drawn within the rectangle. The section identifier may be a file number or filename, or may be a hoop position identifier or other identifier. In a preferred embodiment, the first stitch of each section is marked with an indication called a "section flag".

The above figures describe aspects of the invention illustrated by elements in simplified system diagrams. As will be understood by one of ordinary skill in the art, the elements can be implemented in computer software. The elements can also be implemented in computer hardware. Alternatively, the elements can be implemented in a combination of computer hardware and software. Some of the elements may be integrated with other software and/or hardware. Alternatively, some of the elements may be combined together or even separated. These and other variations, modifications, and alternatives will be apparent by one of ordinary skill in the art.

Figure 4A:
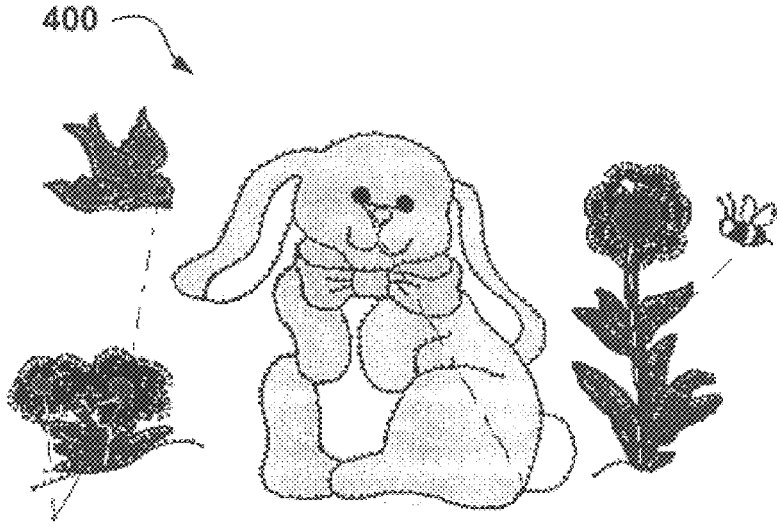
FIGS. 4A to 4C are simplified illustrations of a multiple-section bar according to an embodiment of the present invention.
Figure 4A:
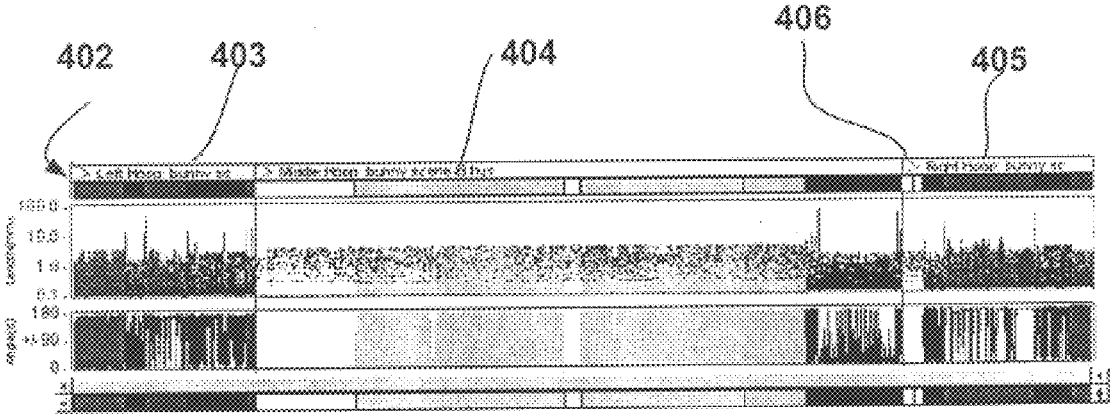
Figure 4B:
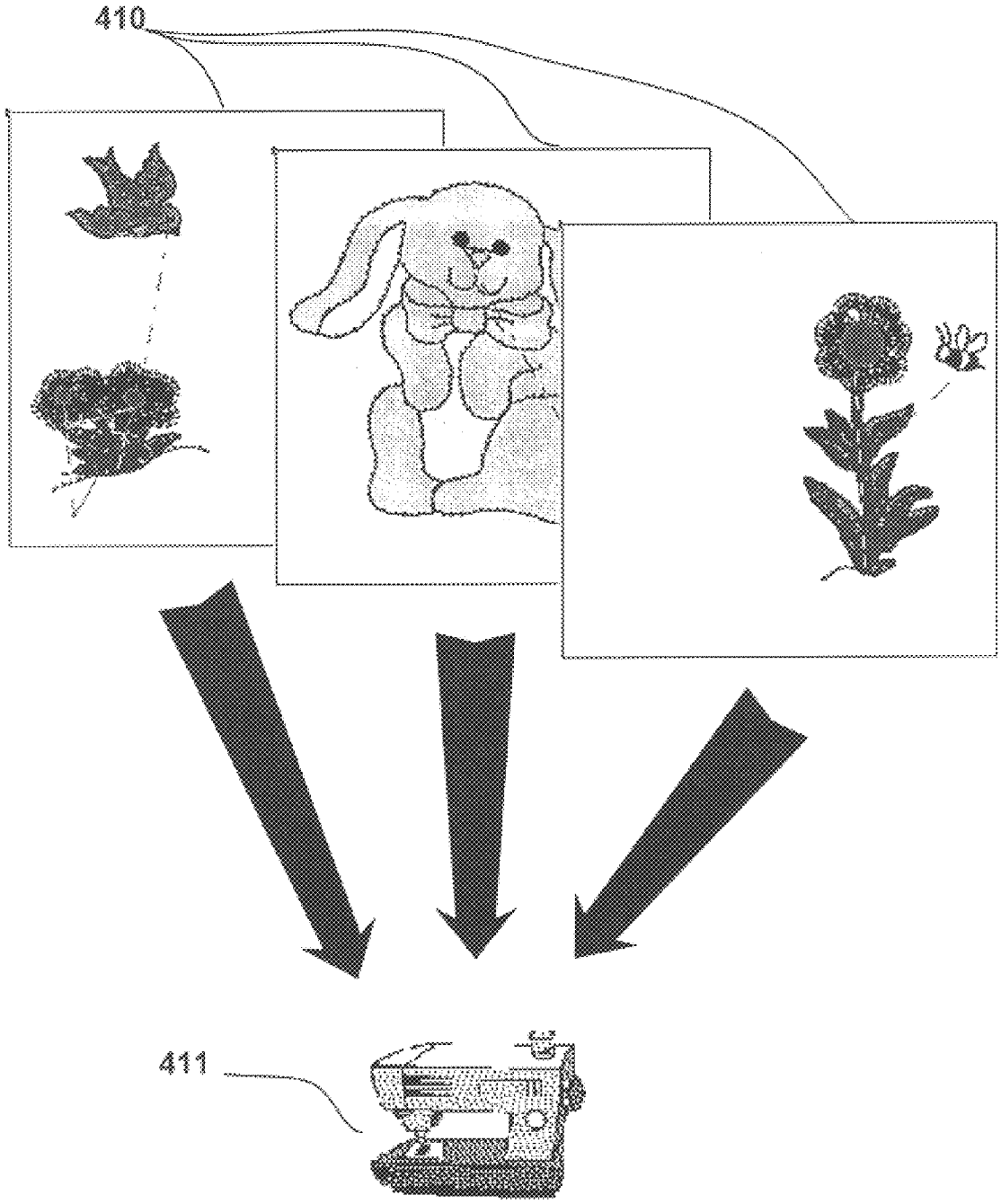
Figure 4C:
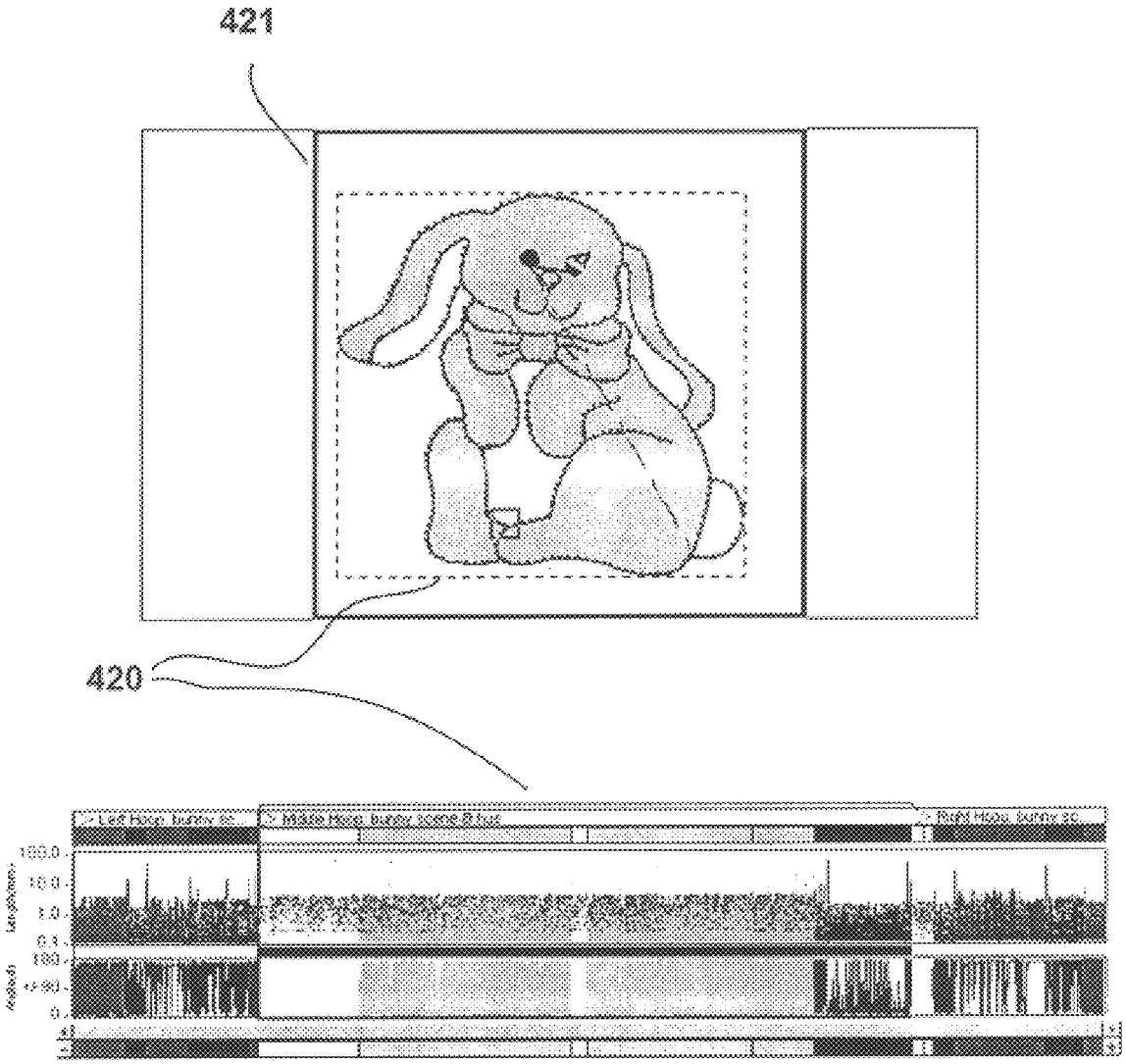

FIG. 4A illustrates a multiple-section design 400 along with a multiple-section chart 402 for the same design. The multiple section design composes a bunny rabbit, flower to its right, and bird to its left. The multiple section design is derived from multiple designs from a plurality of sections. Each section can be an independent design which is within a predetermined size for a file type. The multiple section design, however, is larger than the predetermined size for the file type and is often stitched out using multiple position hoops by conventional techniques. The multiple-section chart, which is illustrated below the design, includes a first section 403, a second section 404, and a third section 405, where the beginning of each section is marked with a new section flag 406 displayed before the first stitch in the section. In this example each section will be saved into a separate file, and eventually the files will be sewn on adjacent areas of a piece of fabric. The fist section 403 will be saved to file named "bunny scene-A.hus", which is to be sewn on the left side of the fabric; the second section 404 will be saved to a file named "bunny scene-B.hus", which is to be sewn in the center of the fabric; the third section 405 will be saved to a file named "bunny scene-C.hus", which is to be sewn on the right side of the fabric. The specific placement of the there sections on the fabric may be described by a "hoop offset", which specifies how many inches or millimeters in the x and y directions to move the fabric within the hoop frame before sewing each design. For example, after sewing the first section of the design in FIG. 4A, and before sewing the second section, the hoop frame should be spatially moved to a certain distance such as 35 millimeters to the right. As illustrated in FIG. 4B, each section is saved in a separate file 410 and the files are separately sent to the sewing machine 411 although there may be other way of doing this.

In an alternative embodiment of the present invention, the hoop frame of a particular section can be highlighted. In FIG. 4B the stitches in the second section of the design have been selected and highlighted 420 both in the stitches in time graphs and in the stitches-in-space display as described previously. When a selection is all contained within one section of a multiple-section design, the hoop frame 421 for that particular section can be highlighted. Highlighting allows the user to easily identify the section in each of the displays.

Depending upon the embodiment, one or more multiple-section charts can be shown on the user interface device. In some embodiments, either scale (i.e., stitch length, stitch number) may be expanded or contracted. Additionally, the present graph can be displayed with any of the graphs or figures herein, as well as others. These and other variations, alternatives, and modifications can be recognized by anyone of ordinary skill in the art.

We previously described how the Stitches-in-Time charts and graphs can be used to aid the user in choosing a starting and ending stitch number which will select a desired figure or part of a design. Pressing and dragging a mouse horizontally in any of the Stitches-in-time graphs specifies a starting stitch and ending stitch, where the starting stitch and ending stitch and all of the stitches in between constitute a selection. The selection can be passed to other algorithms that manipulate the selection.

Figure 5A:
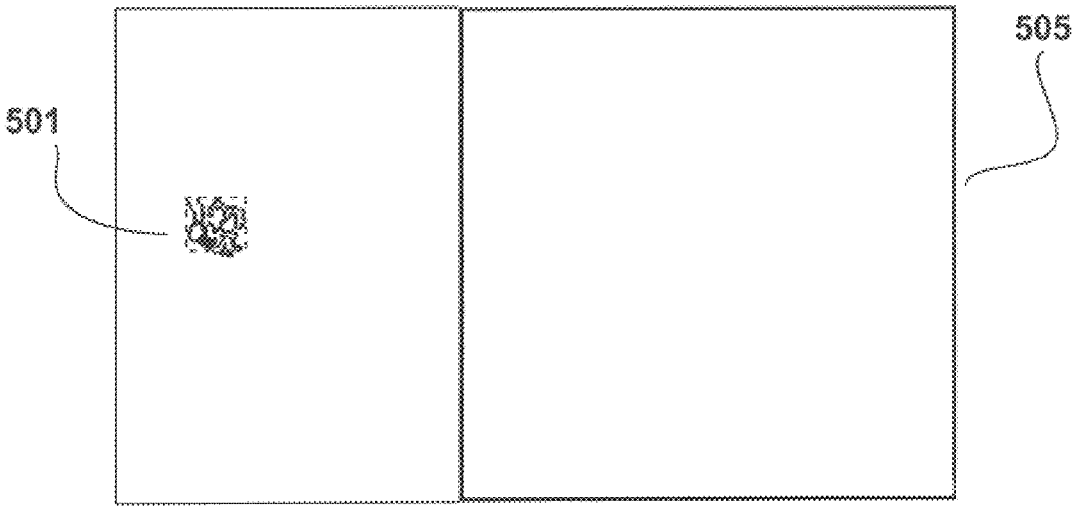
FIGS. 5A to 5B are simplified illustrations of re-assigning stitches to a different section of a multiple-section design according to an embodiment of the present invention.
Figure 5A:
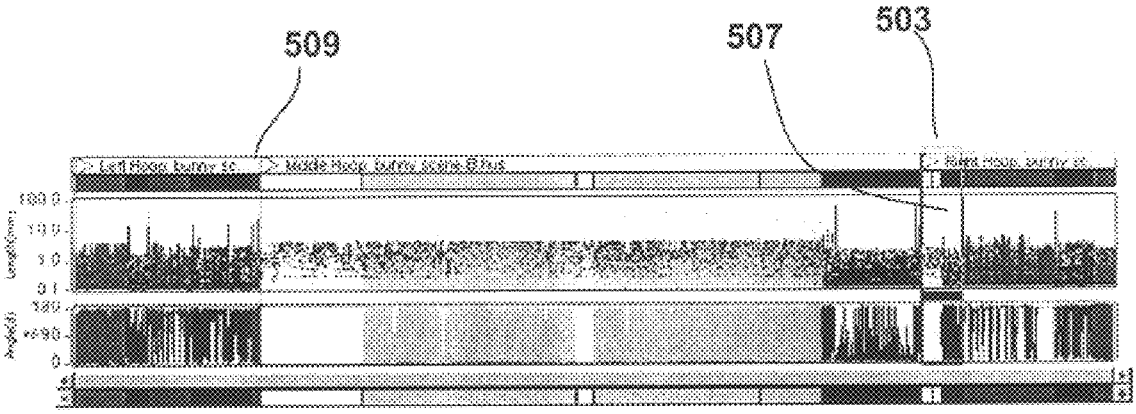
Figure 5B:
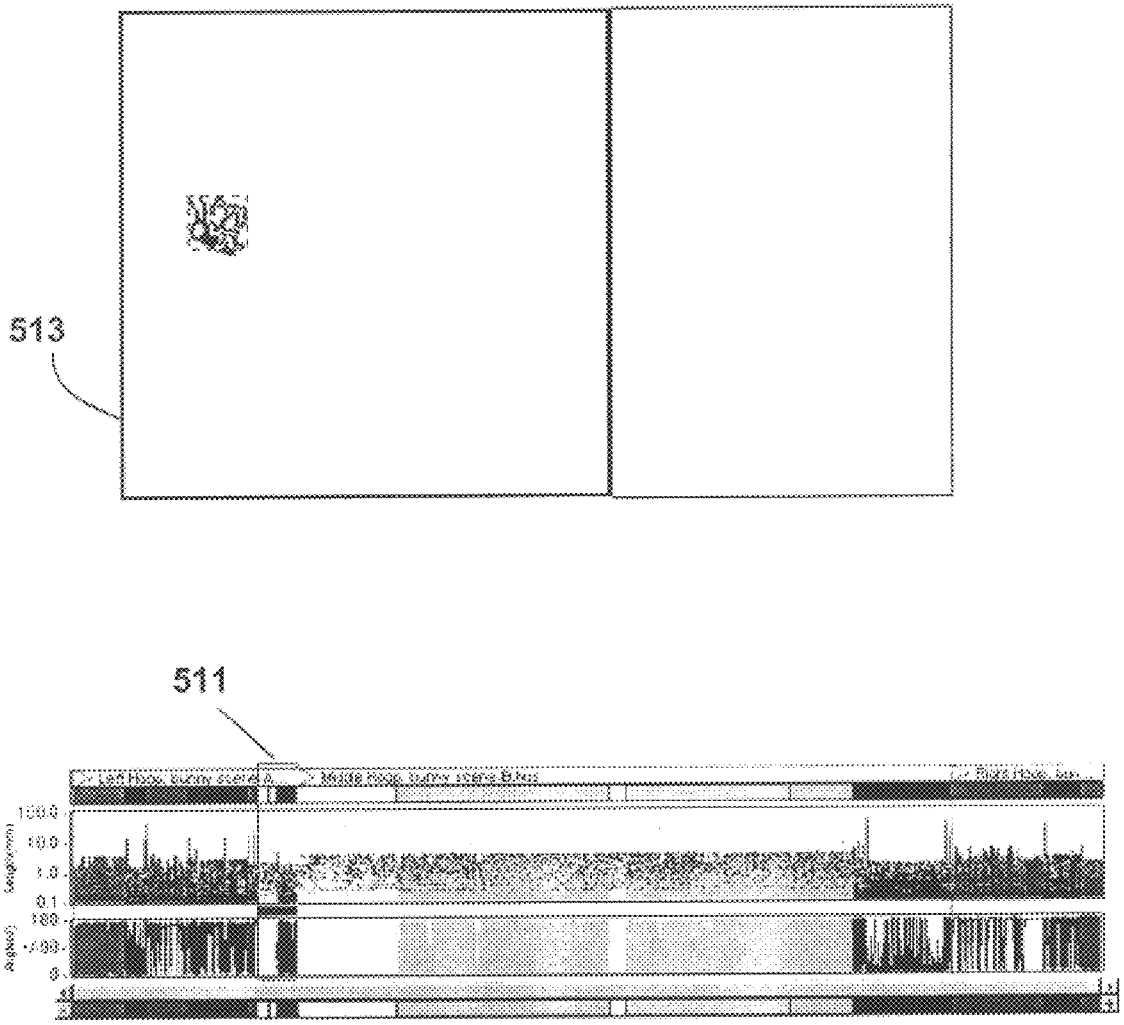

In an alternative embodiment of the present invention, a selection of stitches can be moved by dragging or cutting and pasting or other suitable manipulation from one section to another section of a multiple-section design. In FIG. 5A, bee 501 is in the third file section, as shown by the highlighting 503 in the Stitches-in-time graphs. Also, the hoop highlight 505 shows that the bee lies outside of the hoop frame of the third section. In the present method, positioning the mouse over the stitches 507 of the bee in any of the stitches-in-time graphs, and dragging the mouse cursor to a new location 509 in the Stitches-in-time graph, will move the stitches to the new location. As shown in FIG. 5B, after the manipulation the stitches 511 of the bee are in the first file section. Also, the hoop highlight 513 shows that the bee lies inside of the hoop frame of the first section. By using a mouse or other user interface device, it is relatively easy to move the spatial location of a particular section from one spatial location to another in each of the displays, i.e., Stitches in Time, design display.

Figure 6:
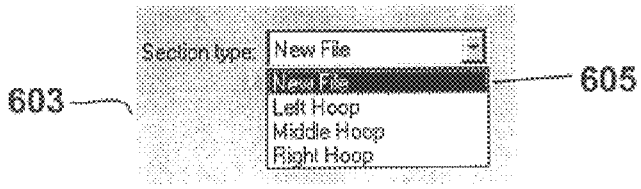
FIG. 6 is a simplified illustration of a way to create a new section in a multiple-section design according to an embodiment of the present invention.
Figure 6:
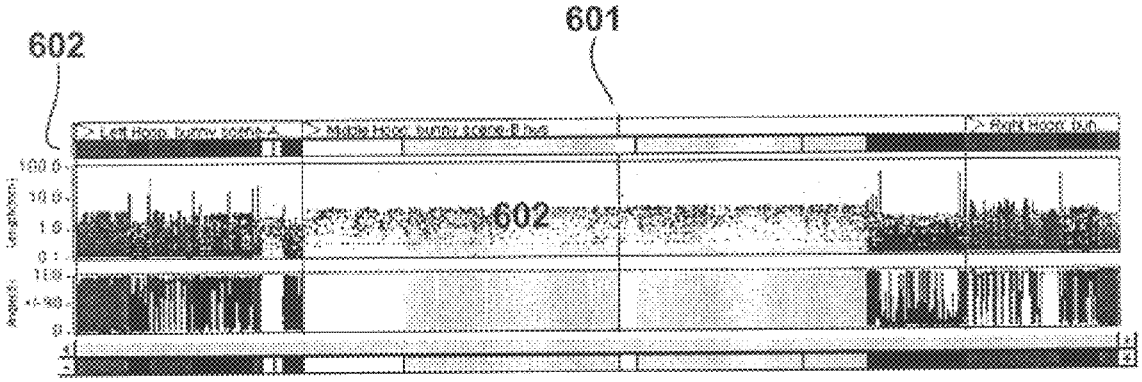
Figure 6:
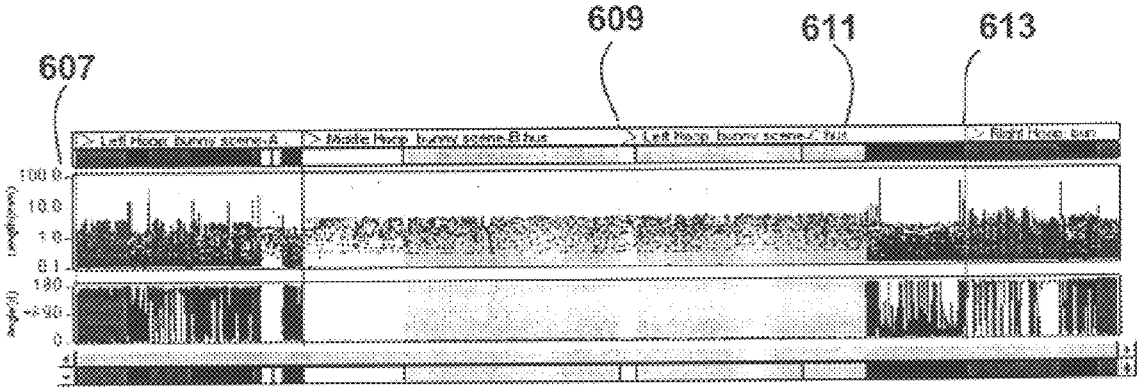

In an alternative embodiment of the present invention, a new section can be added to the design by inserting a section flag before or after any stitch in the design, and designating a section identifier for the newly added section. This is illustrated in FIG. 6. An insertion point 601 is defined before or after any stitch in the design by positioning the mouse cursor in any of the stitches-in-time graphs 602 and depressing the mouse button. To add the new section, the user selects a button on a tool bar, which displays a window with list of possible section identifiers 603, e.g., new file, left hoop, middle hoop, right hoop, and others. In the present example, the user selects section 605 by clicking on item 605 with the mouse. As can be seen in the stitches-in-time graphs 607 of the resultant design, the method adds a section flag 609 at the insertion point, and creates a new section 611 between the section flag 609 and the following section flag 613. If the newly-added section flag is after the last stitch of the design, the new section will contain no stitches, but by methods described above stitches can be later added to the new section. Alternatively, there can be no stitches in the new section.

The above figures describe aspects of the invention illustrated by elements in simplified system diagrams. As will be understood by one of ordinary skill in the art, the elements can be implemented in computer software. The elements can also be implemented in computer hardware. Alternatively, the elements can be implemented in a combination of computer hardware and software. Some of the elements may be integrated with other software and/or hardware. Alternatively, some of the elements may be combined together or even separated. These and other variations, modifications, and alternatives will be apparent by one of ordinary skill in the art.

EXAMPLES

To prove the principles and operation of the present invention, we implemented various aspects using computer software and hardware. This software and hardware are not intended to be limiting in any manner but merely provided for illustrative purposes only. One of ordinary skill in the art would recognize variations, alternatives, and modifications. The computer software is called BuzzEdit™ tools, which is manufactured by Buzz Tools, Inc. of Danville, Calif.

The software tools can be used with almost any suitable computer system. The system can be a Windows™ based operating system manufactured by Microsoft Corporation of Redmond, Wash. The computer should include at least 8MB of RAM or preferably 16 MB of RAM. The display should also include at least 256 colors or more. The computer software has been described in U.S. Provisional Patent Application No. 60/219,077 filed Jul. 18, 2000, Method and System for Modification of Embroidery Stitch Data and Design, noted above. More particularly, we refer to page 65 "Sewing Your Multiple-File Designs," as well as other sections of the provisional patent filing.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A graphical user interface device for providing visual displays of complex embroidery designs having more than one design section, the interface comprising:

a display coupled to a micro processing device and coupled to a memory device;

an electronic representation of a stitch on a first axis of the display, the electronic representation of the stitch being selected from at least one parameter in the group consisting of a stitch number, a time, or a combination of a stitch number and a stitch time, the electronic representation being stored in the memory device; and a plurality of section identifiers, each of the section identifiers corresponding to a plurality of stitches for a section, the plurality of section identifiers being displayed in electronic form on a second axis of the display, whereupon the second axis is associated with the first axis to illustrate the section identifiers as a function of the electronic representation of the stitch, the plurality of section identifier of the stitch being stored in the memory of the device.

2. The device of claim 1 where one or more of the section identifiers is a file name.

3. The device of claim 1 wherein one or more of the section identifiers is a hoop position.

4. The device of claim 1 further comprising an electronic representation of a complex embroidery design outputted on the display.

5. The device of claim 4 wherein the complex embroider design being outputted simultaneously as the electronic representation of the stitch and the plurality of section identifiers.

6. The device of claim 1 wherein each of the sections being stored in a separate file.

7. The device of claim 1 wherein each of the sections being stored in a separate file, each of the sections being a separate and complete design.

8. A graphical user interface device for providing visual displays of complex embroidery designs, the interface comprising:

a display coupled to a micro processing device and coupled to a memory device;

a complex embroidery design outputted on a first portion of the display, the complex embroidery design comprising more than one design section, each of the design sections being capable of a separate and an independent design;

an electronic representation of a stitch on a first axis outputted on a second portion of the display, the electronic representation of the stitch being selected from at least one parameter extended from the group consisting of a stitch number, a time, or a combination of a stitch number and a stitch time, the electronic representation being stored in the memory device; and a plurality of section identifiers, each of the section identifiers corresponding to a plurality of stitches for the design section, the plurality of section identifiers being displayed in electronic form on a second axis outputted on a third portion of the display, whereupon the second axis is associated with the first axis to illustrate the section identifiers as a function of the electronic representation of the stitch, the plurality of section identifiers of the stitch being stored in the memory of the device;

wherein the complex embroidery design is larger than a maximum predetermined size supported by a predetermined file type.

9. The display of claim 8 wherein one of the sections is highlighted.

10. The display of claim 9 wherein one of the section identifiers corresponding to the highlighted section is also highlighted.

11. A method for manipulating a selected design section in complex embroidery designs, the method comprising:

displaying a plurality of sections for a complex embroidery design on a display, each of the sections being displayed in a selected order, each of the sections being illustrated as a stitch property relative to a stitch number or time, the complex embroidery designs being larger than a maximum file type of at least one of the sections included in the complex embroidery design; and selecting one of the sections and moving the selected section to a spatial region either before or after any portion of the other sections to relocate the selected section.

12. The method of claim 11 wherein the selecting is provided by a cursor and a mouse.

13. The method of claim 11 wherein the selecting and moving are a cut and paste process.

14. The method of claim 11 wherein the moving is a dragging process provided by a mouse.

15. The method of claim 11 wherein each of the sections is a separate and independent file.

16. The method of claim 11 wherein each of the sections is identified by a flag, the flag being displayable and stored in a memory.

17. The method of claim 11 wherein each of the sections corresponds to a separate and independent design.

18. The method of claim 11 wherein the displaying is provided by one or more computer codes.

19. The method of claim 11 further comprising inserting a new section in the plurality of sections.

20. The method of claim 19 wherein the new section is selected from a window, the window being displayed in a portion of the display.

21. The device of claim 1 further comprising a third axis, the third axis representing a stitch parameter, the third axis intersecting the first axis in a normal manner, the third axis also intersecting the second axis in a normal manner, the first axis and the second axis being aligned in a parallel manner.

22. The device of claim 21 wherein the stitch parameter is selected from a stitch angle or a stitch length or the stitch angle and the stitch length.

23. The device of claim 8 further comprising a third axis, the third axis representing a stitch parameter, the third axis intersecting the first axis in a normal manner, the third axis also intersecting the second axis in a normal manner, the first axis and the second axis being aligned in a parallel manner.

24. The device of claim 23 wherein the stitch parameter is selected from a stitch angle or a stitch length or the stitch angle and the stitch length.

* * * * *